United States Patent [19]

Spitz

[11] 3,952,345

[45] Apr. 27, 1976

[54] BED FRAME HAVING RELEASABLY INTERLOCKED SIDE RAILS AND CROSSBARS

[76] Inventor: Melvin P. Spitz, 619 N. Elm Drive, Beverly Hills, Calif. 90210

[22] Filed: Aug. 18, 1975

[21] Appl. No.: 605,543

Related U.S. Application Data

[62] Division of Ser. No. 556,914, March 10, 1975.

[52] U.S. Cl. ..... 5/207; 5/200 R

[51] Int. Cl.[2] ..... A47C 19/04

[58] Field of Search ..... 5/176, 200, 201, 207, 5/209, 309

[56] References Cited

UNITED STATES PATENTS

| | | | |
|---|---|---|---|
| 683,803 | 10/1901 | Ruebusch | 5/207 |
| 1,552,131 | 9/1925 | Foster | 5/209 |
| 1,600,524 | 9/1926 | Stackhouse | 5/209 |

*Primary Examiner*—Casmir A. Nunberg
*Attorney, Agent, or Firm*—Whann & McManigal

[57] ABSTRACT

A bed frame of the knockdown type having a pair of side rails and at least one connected adjustable end crossbar cooperable to provide a supporting frame structure for an associated box spring, in which brackets on the side rails are formed to provide sockets for respectively laterally receiving associated end portions of a crossbar therein into seated position where coacting parts respectively on the brackets and crossbar have interlocking engagement and function to retain the end portion of the crossbar against endwise withdrawal from the associated socket.

The crossbar and side rail connection, as noted above, provides an extremely rigid box-like structure which permits frame-supporting leg assemblies to be mounted on the crossbar at a sufficiently inwardly spaced position from the side rail to avoid possible injurious striking of the bare foot or stubbing of toes thereon.

Unique adjustable offset box spring locating and retaining clips are also provided on the side rails to permit the sides of the box spring to extend beyond the side rails.

Each crossbar is constructed with unique adjustable sections permitting the bed frame to be readily adjusted to selectively provide a twin, double or queen size, or queen or king size bed without the use of tools.

13 Claims, 13 Drawing Figures

BED FRAME HAVING RELEASABLY INTERLOCKED SIDE RAILS AND CROSSBARS

This is a division of application Ser. No. 556,914, filed Mar. 10, 1975.

BACKGROUND OF THE INVENTION

The present invention relates to beds generally and to bed frame structures specifically of the knockdown type.

It has heretofore been generally known from U.S. Pat. Nos. 3,537,114 and 3,683,429 to provide a bed-frame assembly of the knockdown type in which a cross frame member is detachably secured to side frame members. In these patents, interfitting male and female members are utilized, one of the members being secured to the side frame member and the other being mounted on an associated end of the cross frame in a manner to extend transversely across and spaced from the end terminus of the connected cross frame. The design configuration of the male and female members, as disclosed in these patents, is rather complex and expensive to produce, and have an orientation such that in their assembled relation the parts do not provide as great rigidity as might be desired. For example, the rigidity of the connection between the side frame member and cross frame member is not sufficiently rigid to permit the mounting of frame supporting leg assemblies on the cross frame at a sufficiently inwardly spaced position from the side frame to avoid injurious striking of a person's bare feet or stubbing one's toes thereon. As a consequence, these patents disclose the supporting leg assemblies as being secured to the connection means and thus have the disadvantage of extending immediately below the side frame members in a position where they constitute a dangerous hazard.

the present invention obviates the above noted problems and inherent disadvantages of the patented arrangements by providing a simplified and extremely rigid structural concept for releasably interconnecting the side rail and a crossbar end, in which a bracket on the side rail is so formed as to provide a box-like structure having an elongate socket extending inwardly at a right angle to the side rail, the socket being designed to laterally receive an end portion of the crossbar into a seated position which is coaxial with the longitudinal axis of the socket. In the seated position of the crossbar end, coacting parts respectively on opposite sides of the bracket and crossbar have interlocking engagement and function to retain the crossbar against endwise withdrawal from the socket. An extremely high order of rigidity is thus obtained, so that it now becomes possible to provide a frame supporting leg assembly which may be secured directly to the crossbar end portion independently of the interconnecting means at the desired inwardly spaced position with respect to the side rail and thus minimize the possibility of injury.

Further, it has been generally known to provide box spring locating and retaining clips on the side rails of bed frames. As shown in the previously noted patents, these clips may be permanently secured as by riveting at desired locations along the side rails, or as disclosed in U.S. Pat. No. 3,510,887, these locating clips may be attached to the side rail in a manner permitting their selectively adjustable movement along the rail and location at any desired position.

While the known retaining clips as shown in the above patents operate more or less satisfactorily in most cases, it will be appreciated that because of variations in the manufactured widths of box springs, the clips of the above discussed character may not always firmly engage the sides of the box spring.

The above noted drawbacks are avoided by the adjustable clip structure of the present invention, which enables the clip to be adjustably extended and retracted and latched in adjusted operating position in which it firmly grips the edge of the box spring structure.

It has also been known generally, as exemplified by U.S. Pat. Nos. 3,646,623 and 3,781,930, to provide a bed frame structure in which the side rails are interconnected by one or more longitudinally adjustable crossbars by means of which the bed frame may be selectively varied as to width in order to provide a plurality of standard bed widths, for example, a twin, double or queen size bed without the use of tools.

The present invention embodies a unique highly effective but simplified arrangement in which the crossbar is composed of telescoped sections which are interconnected for telescoping limited extendable and retractable longitudinal movements. At their adjacent overlapped ends, the outermost of the telescoped sections is provided at its end terminus with a pivoted locking clip which is manually swingable between a released position and a locking position wherein it lays flat against a side face of the section. The innermost of the telescoped sections carries a plurality of transversely extending slots which are spaced longitudinally along the section at distances corresponding to the respective bed widths, each of these slots at a selected bed width being adapted to receive a tongue projection of the locking clip, when the clip is in its locking position. The tongue projection, while positioned in a slot, effectively anchors the telescoped sections against longitudinal movements, but upon swinging movement of the locking clip to its released position will readily enable the crossbar to be adjusted to another bed width and locked.

SUMMARY OF THE INVENTION

The present invention relates to bed frame structures, and is more specifically concerned with improvements for facilitating the interconnection and adjustment of the bed frame components.

It is an important object and feature of the herein described invention to provide an improved bed frame of the knockdown type having side rails and interconnecting crossbars; which is capable of being quickly assembled; which does not require the use of small parts, such as bolts, nuts or clamps; and which requires no tools for effecting the assembly or disassembly of the respective components.

A further object of the invention is to provide a bed frame according to the foregoing object, which embodies unique means of simple construction for interconnecting the ends of the crossbars with the side rails; and which will be sufficiently rigid to permit the mounting of bed frame supporting leg assemblies directly on the crossbars at positions inwardly spaced from the side rails to such extent that bodily injury as by striking bare feet or stubbing of the toes against the leg assemblies, will be averted.

In conventional bed frames it has been known to provide the side rails with fixed box spring retaining tabs or clips in order to recess the otherwise unsightly and potentially hazardous side rails so that they will be concealed by the overhanging sides of the box spring. These fixed tabs or clips were not entirely satisfactory for the reason that in some cases the clips projected beyond the sides of the box spring and thus constituted a dangerous hazard.

With a view to correcting the foregoing problem, it is a further object of the invention to provide an improved and unique box spring retaining clip which is adjustably extendable and retractable, without the use of tools, so as to snugly engage the sides of the box springs which may vary slightly as to their widths.

Another object is to provide a unique sectionalized crossbar which is adjustable without the use of tools to selectively vary the width of a bed frame to provide, e.g., a twin, double or queen size bed; in which the crossbar is composed of adjustable telescoped sections which cannot be disengaged completely; which is devoid of loose parts such as nuts or clamps; and which embodies a simple and effective mechanism for releasably locking the sections in a selected adjusted position.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only.

DESCRIPTION OF THE PREFERRED EMBODIMENTS

Figure 1:
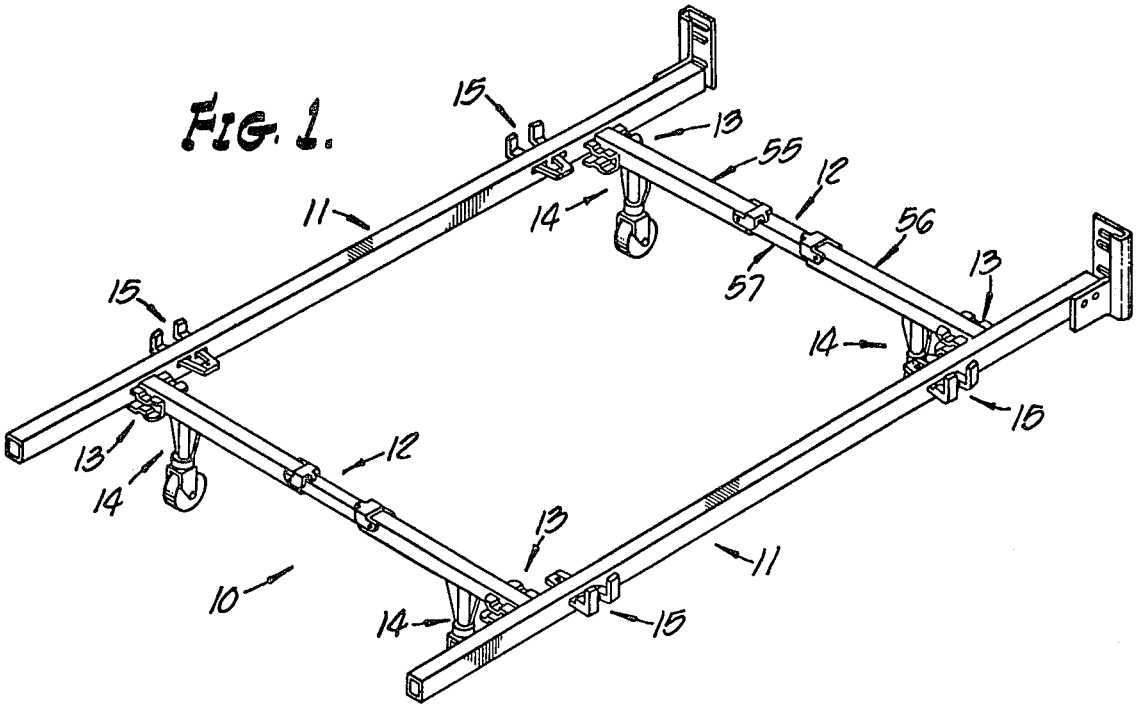
FIG. 1 is a perspective view of a bed frame structure embodying the features of the present invention.

Referring now specifically to the drawings, for illustrative purposes, a bed frame embodying the features of the present invention is indicated in its entirety by numeral 10 in FIG. 1, and is shown as comprising a pair of spaced parallel side rails 11 which are interconnected by one or more perpendicularly extending crossbars 12. The crossbars are releasably connected at their end portions by connecting means as generally indicated at 13, to provide an assembled bed frame structure for supporting an associated box spring, the assembled bed frame being supported in an elevated position by means of leg assemblies, as generally indicated at 14. The leg assemblies are respectively mounted directly on the end portions of the crossbars and are sufficiently inwardly spaced from the side rails to avoid injurious striking with one's bare feet or stubbing one's toes thereon.

The side rails are provided with adjustable box spring retaining tabs or clips 15 which are so designed that they may be selectively adjusted so as to snugly fit against the sides of the supported box spring. This arrangement enables the box spring to be positioned so as to extend beyond the associated side rails, and thus conceal the rails which otherwise would be conspicuous, unsightly and hazardous. The clip structure of the present invention, as will be more fully explained later, avoids the inherent disadvantages of the conventional fixed clip which under certain conditions may extend beyond the sides of the supported box spring in such a manner as to provide a dangerous hazard.

The Crossbar-Side Rail Connecting Means

In the present invention, it is a main design objective to provide rail and crossbar structures and connecting means of a character which will produce a bed frame assembly having great rigidity. The side rails and crossbars may comprise standard multisided extrusions of conventional form, but preferably are tubular form having flanges or side walls in right-angled relation. Another feature of the connecting means of the present invention is that connections are made with an end portion of the crossbar at a zone which is inwardly spaced from the crossbar end terminus.

Figure 3:
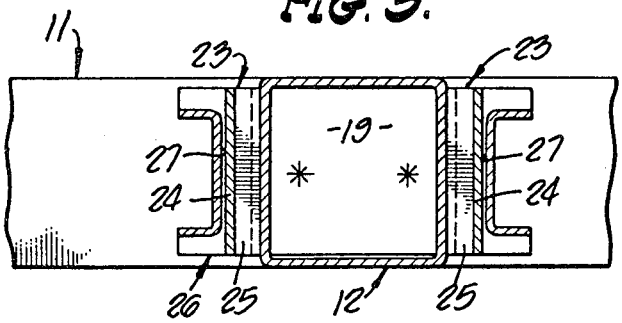
FIG. 3 is a transverse sectional view taken substantially on line 3—3 of FIG. 2.
Figure 2:
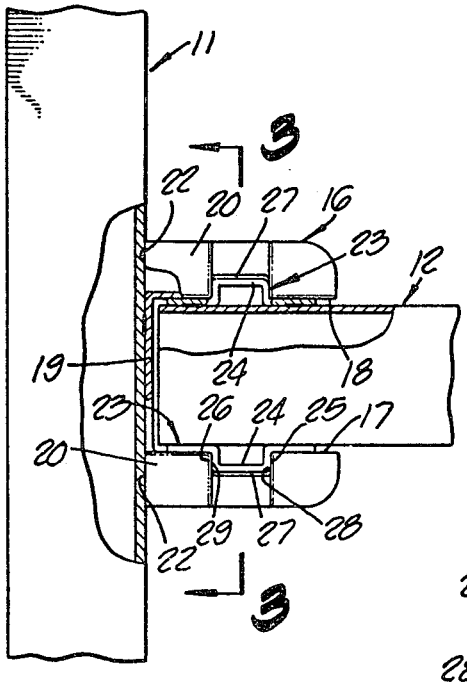
FIG. 2 is an enlarged fragmentary plan view, partly in section, showing details of the releasable connection between a bed side rail and associated crossbar according to the present invention.
Figure 4:
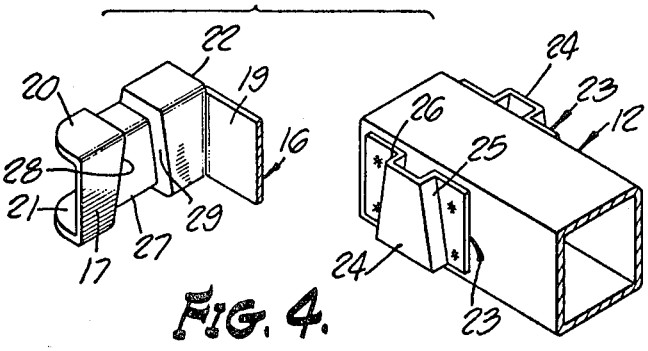
FIG. 4 is an exploded perspective view showing details of the interlocking parts of the connection between the crossbar and side rail.

More specifically, as best shown in FIGS. 2–4, the connecting means 13 comprises a generally U-shaped side rail bracket 16 in which spaced apart side walls 17 and 18 extend outwardly from an integrally formed bridging wall 19 which is secured to a side flange of the side rail as by welding or other appropriate means. Each side wall of the bracket is further strengthened and rigidified by providing outwardly extending flanges 20 and 21 respectively at the upper and lower edges of the side wall. These flanges each have an inner end edge 22 adjacent the bridging wall 19 which is adapted to bear against the adjacent wall surface of the associated side rail on which the bracket is mounted.

The bracket, as thus far described, provides in effect an elongate socket having an axis extending at rightangles to the connected side rail, this socket being adapted to laterally receive an end portion of a connected crossbar 12 in an upward direction into a seated position with the axis of the crossbar end portion coaxial with the axis of the socket.

In the seated position of the crossbar end portion in an associated bracket 16, coacting parts respectively on the bracket and crossbar end portion are provided to make interlocked engagement and retain the end portion of the crossbar against endwise withdrawal from the socket. For this purpose, the end portion of the crossbar 12 is provided with transversely aligned clips or fastening members 23 which are respectively secured to the side walls of the crossbar end portion by means of welding or other suitable means. Each fastening member is deformed to provide an outwardly offset projecting tongue 24 with upwardly converging side wall portions 25 and 26 to form in effect a wedge.

The tongue 24 is adapted in the seated position of the end portion of the crossbar to interfittingly coact with an outwardly offset recessed groove 27 on the adjacent bracket wall and having side wall portions 28 and 29 which upwardly converge to form a wedging groove compatible with the wedge 24.

With the interconnecting means as described above, the side rails and crossbars may be assembled to form the bed frame without the use of tools, and when so assembled provide a very rigid connection which makes it possible to secure the respective leg assemblies 14 directly to the crossbar end portions at positions inwardly spaced from the side rails so as to minimize the possibility of bodily injury.

Figures 5, 6, 7, 8, 9, 10, 11, 12, 13:
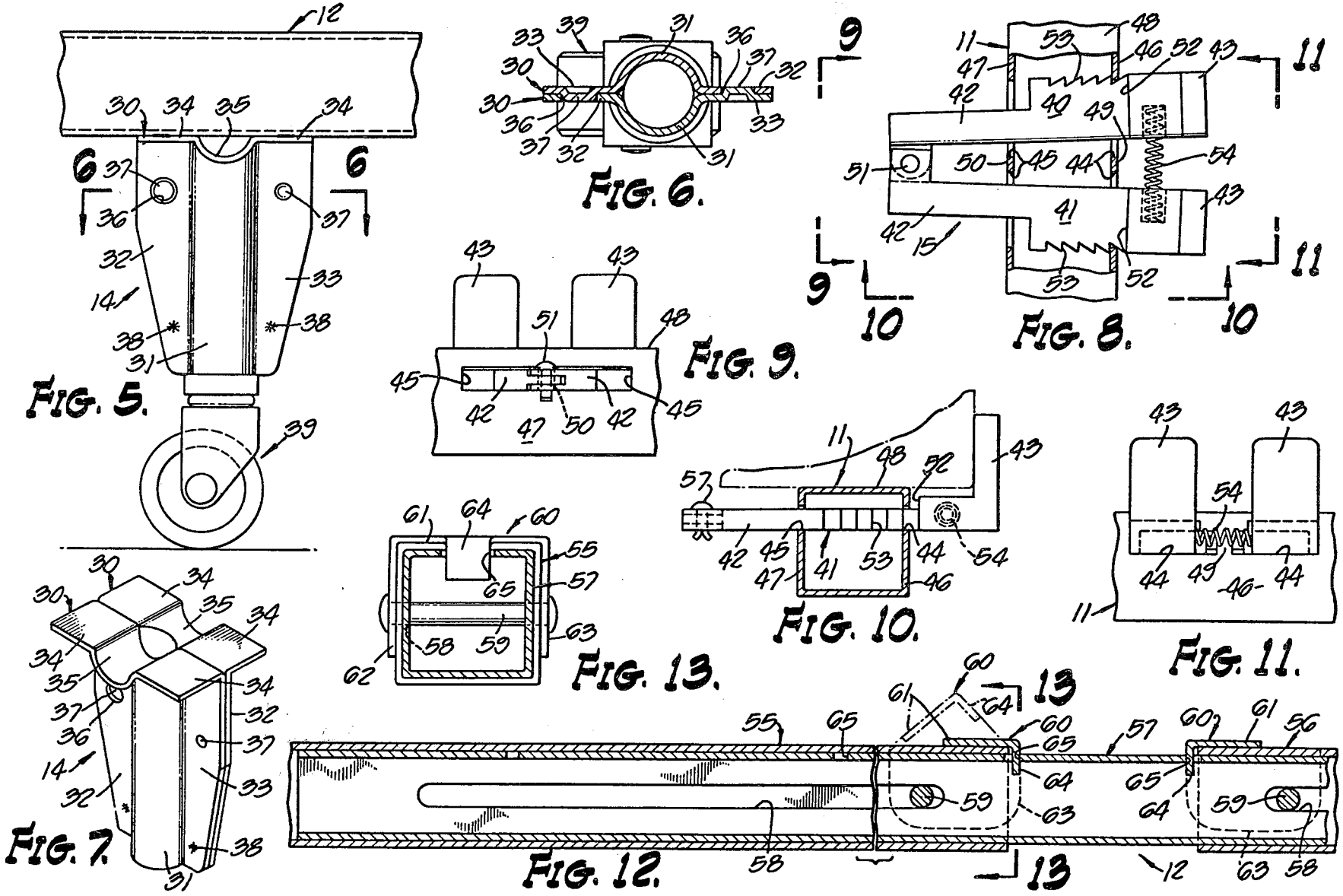
FIG. 5 is a fragmentary elevational view of a bed frame supporting leg assembly as embodied in the present invention.
FIG. 6 is a transverse section of the leg assembly, taken substantially on line 6—6 of FIG. 5.
FIG. 7 is a perspective view showing structural details of the leg structure.
FIG. 8 is a fragmentary plan view of an adjustable box spring retaining clip according to the present invention, and showing the manner in which it is mounted on an associated side rail.
FIG. 9 is an elevational view, partly in section, of the rail mounted clip, as viewed substantially along line 9—9 of FIG. 8.
FIG. 10 is a side elevational view of the same, partly in section, as seen substantially on line 10—10 of FIG. 8.
FIG. 11 is an elevational view of the outer end of the rail mounted clip, partly in section, as seen substantially on line 11—11 of FIG. 8.
FIG. 12 is a fragmentary vertical sectional view taken through one of the frame crossbars, showing the telescoped sections and locking clip for anchoring the bar in adjusted position.
FIG. 13 is a transverse sectional view of the same taken substantially on line 13—13 of FIG. 12.

The leg assembly 14 according to the present invention is shown in FIGS. 5, 6 and 7 as comprising a pair of similarly deformed members 30 which are secured together to form the leg assembly. Each member is stamped or otherwise formed to provide an integrally formed body with a longitudinally extending semicircular central portion 31 with diametrically opposed outwardly extending flanges 32 and 33, these flanges being preferably tapered in their lowermost end portions. The uppermost end is deformed to provide a substantially right-angled flange 34 having a transversely extending semicircular portion 35. The flange 32 adjacent its uppermost end is provided with a circular opening 36 while the flange 33 on the opposite side is provided with an inwardly upset circular projection 37.

As will best be seen in FIG. 6, the opening 36 and circular projection of the pairs of members 30 serve as guides to initially properly position the members in assembled relation with their side flanges 32 and 33 in engagement. As thus initially assembled, the pair of members may be fixedly secured together as by spot welding as indicated at 38, or other suitable means.

As thus assembled, the pair of members 30 cooperate to form a tubular portion at their lowermost ends to receive the mounting shank or stem (not shown) of a conventional caster 39. The uppermost ends of the connected pair of members cooperate to provide an end flanged structure which can be secured as by welding or other suitable means to the lowermost flange or side wall of the associated crossbar 12.

The Box Spring Retaining Clips

Referring now to FIGS. 8–11, the box spring retaining clips 15 are constructed as unitary assemblies which can be mounted in the side rails 11, and as thus mounted may be adjustably extended and retracted with respect to the associated side rail so as to snugly engage the adjacent side of the box spring.

Each clip assembly is of a generally L-shaped configuration, and comprises a pair of L-shaped members 40 and 41 which may be formed of injection-molded plastic, or other suitable material, to provide in each case an elongate base leg 42 and a shorter right-angled end leg 43. As shown in FIG. 3, each leg 42 is positioned for sliding movement in transversely aligned slots 44 and 45 respectively in an outer flange wall 46 and inner flange wall 47 of the associated side rail. As thus mounted, the base leg is disposed below the upper flange wall 48 of the side rail. It will be noted that the adjacent ends of the slots 44 are separated by a narrow web 49, while the slots 45 have their adjacent ends separated by a narrow web 50.

The outermost ends of the base legs 42 are hingedly interconnected for relative swinging movement by means of a pivot pin 51 which also forms a stop which limits the movement of the connected members 40 and 41 in an outward direction to a position which would permit their detachment from the associated rail. Movement in an opposite direction is limited by abutment projections in the form of a shoulder 52 in each case which is inwardly spaced from the leg 43. The members 40 and 41 are provided in each case with a series of serrations 53 along their outer marginal edge for engagement with adjacent edges of the slots 44, when the outermost ends of the members are urged apart by means of a coiled spring 54 extending therebetween. However, by pressing the outermost ends of the members 40 and 41 towards each other, the serrations will be moved into disengaged positions which will permit adjustment of the clip to a desired position in transverse relation to the associated side rail. Upon releasing the pressure on the outer ends of the members, the spring 54 will again urge the members into an adjusted latched position.

The Adjustable Crossbar Structure

The crossbars 12 are longitudinally adjustable and arranged to be locked in adjusted position so as to enable the width of the bed frame to be selectively varied to provide a plurality of different bed widths.

More specifically, as best shown in FIGS. 12 and 13, each crossbar is provided with telescoped sections. As illustrated, the crossbar is composed of two end sections 55 and 56, and a central section 57 which has its end portions telescoped within the adjacent end portions of the end sections 55 and 56. The crossbar sections are fabricated from multisided extruded members, and for strength are preferably comprised of tubular members having a rectangular cross-section.

The telescoped end of each end section and an end of the central section are interconnected for limited longitudinal axial adjustment. For this purpose, the end portion of the central section 57 is provided on its opposite side walls or flanges with transversely aligned elongate slots 58. A transversely extending pin 59 is positioned adjacent the end terminus of the telescoping end of the end section, this pin extending through the slots 58 and the adjacent side walls of the telescoped end portion of the end section and in which the pin ends are fixedly anchored. As thus arranged, the telescoped sections of the crossbar are adjustably connected to provide a unitized crossbar structure in which the separate sections are not readily disconnectable into separate parts.

In order to releasably lock the telescoped sections of the crossbar in an adjusted position, the inner telescoped end of each end section is provided with a swingably mounted clip 60 which is fabricated from a suitable flat material to provide a generally U-shaped configuration having a bridging portion 61 and integrally formed spaced side leg portions 62 and 63, which are adapted to conform to the top and side walls of the end section. The clip is pivoted for swinging movement on the end portions of the pin 59 which are extended through the side leg portions 62 and 63 of the clip. As thus pivoted, the clip is swingable between a locking position as shown in full lines in FIG. 12, and a non-locking position as indicated in phantom lines. The clip is provided on its bridging portion 61 with an angularly extending tongue projection 64 which is adapted, in the locking position of the clip, to extend over the inner end terminus of the end section upon which the clip is mounted.

The associated telescoped end portions of the central section are provided in their upper wall or flange with a series of longitudinally spaced apart transversely extending slots 65 which are determinative of the various bed widths. In each adjusted position, the tongue 64 in the locked position of the clip is adapted to extend into the selected slot for an adjusted bed width, and in this position serves to lock the crossbar sections against longitudinal movement. The clip 60 as thus constructed has the advantage that, in locked position, the bridging portion 61 will lie flatly against the adjacent side of the associated tubular member. As a consequence, there are no projecting portions above the crossbar which will interfere or prevent supporting engagement thereon by the associated box spring. Also, the box spring tends to retain the clip in its locking position.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. In a bed frame having an elongate side rail with an upper flange providing a support for a box spring adapted to project outwardly therebeyond, a box spring locating and retaining clip structure, comprising:

a. a generally L-shaped body structure having a base leg and a shorter right angled leg at one end thereof;

b. means adjustably mounting said body on said rail for movements in extendable and retractable directions with said base leg extending transversely of the rail below said upper flange and with said end leg being positioned outwardly of said upper flange and projecting above the plane thereof to engage a projecting side of the box spring; and c. means for releasably latching said body against movement in said extendable direction from an adjusted position.

2. A bed frame as set forth in claim 1, wherein said side rail comprises side flange means extending below said upper flange and having slot means therein for guidingly receiving said base leg therein for sliding movements in opposite directions in response to said body movements; and means at the respective ends of said base leg for limiting said movements of said body in said extendable and retractable directions.

3. A bed frame as set forth in claim 2, wherein said limiting means at the other end of said base leg is removable to enable detachment of said body from its associated side rail.

4. A bed frame as set forth in claim 2, wherein said limiting means at said one end of said base leg comprises an abutment in spaced relation to said shorter end leg.

5. A bed frame as set forth in claim 2, wherein said side flange means comprises a pair of spaced apart parallel side flanges, and said slot means comprises slots in said flanges aligned transversely of said rail for supporting said base leg.

6. A bed frame as set forth in claim 2, wherein said means for releasably latching said body includes lateral serrations carried by said body normally engaged with an adjacent portion of said side rail, said serrations being manually disengageable to permit adjusting movements of said body.

7. A bed frame as set forth in claim 6, wherein said serrations are resiliently urged in the direction of said engagement.

8. A bed frame according to claim 1, in which said L-shaped body structure comprises a pair of L-shaped members having their base legs pivotally interconnected at their outermost ends; and said serrations are formed on the outer edges of said base legs in spaced relation to the pivot interconnection.

9. A bed frame as set forth in claim 8, in which the free ends of said base legs are resiliently urged apart by a spring member extending therebetween.

10. A bed frame as set forth in claim 9, in which the free ends of said base legs have exposed finger engageable portions for manually moving said free ends toward each other.

11. A bed frame as set forth in claim 8, in which each of said pair of L-shaped members is positioned in openings formed in rail side flanges extending below said upper flange.

12. An adjustable box spring locating and retaining clip for a bed frame side rail, comprising the combination of:

a. a pair of L-shaped members in side-by-side relation, each having a relatively long base leg and a relatively shorter right angled upstanding leg at one end;

b. an abutment projection on each of said members adjacent the juncture of the base leg with the upstanding leg;

c. pivot means connecting the other ends of the base legs of said pair of members for relative swinging movements;

d. serrations formed on each of said base legs along opposite outer edge marginal portions positioned between its upstanding leg and said pivot means; and e. spring means for normally urging the free ends of said pair of members away from each other.

13. The combination according to claim 12, wherein said pivot means comprises a removable stop member.

* * * * *